US008734050B1

(12) United States Patent
Mercier

(10) Patent No.: US 8,734,050 B1
(45) Date of Patent: May 27, 2014

(54) INFILTRATION TRENCH FILLER SYSTEM AND METHOD

(71) Applicant: Craig Mercier, Harmans, MD (US)

(72) Inventor: Craig Mercier, Harmans, MD (US)

( * ) Notice: Subject to any disclaimer, the term of this patent is extended or adjusted under 35 U.S.C. 154(b) by 0 days.

(21) Appl. No.: 13/959,290

(22) Filed: Aug. 5, 2013

Related U.S. Application Data

(60) Provisional application No. 61/679,328, filed on Aug. 3, 2012.

(51) Int. Cl.
*E01C 19/20* (2006.01)

(52) U.S. Cl.
USPC ..... 404/109; 37/142.5; 405/179

(58) Field of Classification Search
USPC ..... 404/101, 105, 106, 108, 109; 37/142.5; 405/179; 198/312
See application file for complete search history.

(56) References Cited

U.S. PATENT DOCUMENTS

| | | | | | |
|---|---|---|---|---|---|
| 3,710,695 | A | * | 1/1973 | Miller et al. | 404/98 |
| 3,856,425 | A | * | 12/1974 | Miller et al. | 404/84.2 |
| 3,908,292 | A | | 9/1975 | Harris | |
| 4,343,389 | A | | 8/1982 | Ponstein | |
| 4,540,327 | A | * | 9/1985 | Happel et al. | 414/352 |
| 4,861,461 | A | * | 8/1989 | Utterback | 209/234 |
| 4,955,756 | A | * | 9/1990 | Klamar | 405/179 |
| 5,084,991 | A | * | 2/1992 | Cronk, Jr. | 37/142.5 |
| 5,097,610 | A | * | 3/1992 | Bishop | 37/142.5 |
| 5,259,699 | A | | 11/1993 | Klamar | |
| 5,271,168 | A | | 12/1993 | Wilson, Sr. et al. | |
| 5,363,574 | A | * | 11/1994 | Osadchuk | 37/142.5 |
| 5,938,373 | A | | 8/1999 | Scudder | |
| 6,158,925 | A | * | 12/2000 | Schleining et al. | 405/179 |
| 6,302,257 | B1 | * | 10/2001 | Woods | 198/311 |
| 6,418,644 | B1 | | 7/2002 | Bykov et al. | |
| 6,502,333 | B1 | | 1/2003 | Striegel | |
| 6,763,925 | B2 | * | 7/2004 | Woods | 198/311 |
| 7,581,903 | B1 | | 9/2009 | Scola | |
| 7,886,463 | B2 | * | 2/2011 | Greenberg et al. | 37/142.5 |
| 7,927,059 | B2 | | 4/2011 | Grassi et al. | |
| 8,157,477 | B2 | | 4/2012 | Horan et al. | |
| 2002/0066214 | A1 | | 6/2002 | Miyazaki | |
| 2007/0134067 | A1 | | 6/2007 | Barnes | |
| 2009/0035110 | A1 | | 2/2009 | Woods, Jr. | |

* cited by examiner

*Primary Examiner* — Gary Hartmann
(74) *Attorney, Agent, or Firm* — Rosenberg, Klein & Lee

(57) ABSTRACT

A system and method are provided for depositing fragmentized stonework material in layers within a drainage trench extending alongside a roadway. The system includes a mobile platform, a dispensing arm portion, an actuating portion and a controller. The mobile platform defines a storage compartment for intermediately storing the fragmentized stonework material received from a predetermined source. The dispensing arm portion is coupled to extend transversely from the storage compartment and is selectively activated to convey and expel the fragmentized stonework material from the storage compartment into the drainage trench. The actuating portion couples the dispensing arm portion to the mobile platform in angularly displaceable manner. The is controller coupled to selectively activate the actuating portion and thereby adjust the dispensing arm portion in angular position relative to the storage compartment to maintain substantially even distribution of the fragmentized stonework material in the drainage trench.

7 Claims, 3 Drawing Sheets

INFILTRATION TRENCH FILLER SYSTEM AND METHOD

RELATED APPLICATION DATA

This Application is based on Provisional Patent Application No. 61/679,328, filed 3 Aug. 2012.

BACKGROUND OF THE INVENTION

Storm drains serve as a direct connection from roadways to waterways. Storm drains are beneficial inasmuch as they prevent roadways from flooding after the accumulation of a significant amount of rain water, yet such has a deleterious effect on the waterways into which the rain water is released. As vehicles travel on roadways, grease, oil and other noxious substances and debris are transferred onto the road surface. When rainfall accumulates, it washes these and other pollutants from the road into neighboring storm drains. In some cases, runoff may travel hundreds of feet downhill before coming into contact with a storm drain, collecting additional pollutants along the way. The storm drains, therefore, act as a conduit for the passage of pollutants directly into surrounding waterways. Thus, it is desirable to create filtering trenches in communication with a particular storm drain such that runoff and other pollutants in both solid and liquid form, can be filtered therethrough before being subsequently passed through the storm drain and ultimately released into a waterway.

Trenches come in a variety of sizes and forms, and are often quite large and expansive. For instance, trenches on the order of approximately 8 feet wide by 4 feet deep may extend a length between 200 and 400 feet. These trenches are strategically located alongside highways or other roadways and are beginning to be seen in neighborhoods, specifically, newly emerging neighborhoods. The idea is to catch the harmful material and filter it out before the water passes through the normal channels, and eventually into the natural water supply. While such trenches have proven beneficial in minimizing the pollutants dumped into waterways, the conventional manner of creating trenches requires a substantial amount of manpower, and the overall process is very time consuming, labor intensive and expensive.

Presently, once a trench has been dug, an excavator and dump truck are situated on a portion of a roadway adjacent to the trench. The excavator is used to scoop material from the back of a dump truck and dropped into the trench, one scoop at a time. Workers then manually distribute and spread the material dropped into the trench to form a layer. After one layer of filler material has been filled into the trench along its entire length, the process begins with a subsequent layer until the trench has been completely filled. As the truck and excavator are disposed on or near the road surface during the process, a portion of the roadway must be shut down while trench filling is taking place. Since this process is very time consuming, roads remain blocked for substantial periods of time, which is highly inconvenient and often leads to a substantial amount of traffic congestion.

There is therefore a need for a more time, labor and cost effective system. There is also a need for a system which is less burdensome on roadway traffic congestion. Additionally, a system is needed in which component parts function more effectively together without risking damage to one component by another.

SUMMARY OF THE INVENTION

It is an object of the present invention to provide a system and method for filling drainage trenches with filler material directly from a storage compartment of an infiltration trench filler vehicle (ITFV).

It is another object of the present invention to provide a system for filling infiltration trenches wherein the storage compartment is readily replenished by material stored in a truck bed of a vehicle in communication therewith.

It is a further object of the present invention to provide a system and method for filling drainage trenches with a plurality of filler material layers disposed in a substantially level manner.

These and other objects are attained in a system for depositing fragmentized stonework material in layers within a drainage trench extending alongside a roadway. The system includes a mobile platform defining a storage compartment for intermediately storing the fragmentized stonework material received from a predetermined source. A dispensing arm portion is coupled to extend transversely from the storage compartment, the dispensing arm portion being selectively activated to convey and expel the fragmentized stonework material from the storage compartment into the drainage trench. An actuating portion couples the dispensing arm portion to the mobile platform in angularly displaceable manner. Furthermore, a controller is coupled to selectively activate the actuating portion and thereby adjust the dispensing arm portion in angular position relative to the storage compartment to maintain substantially even distribution of the fragmentized stonework material in the drainage trench.

In certain embodiments a system for successively depositing layers of respective fragmentized stonework materials to form a multi-layered infiltration structure within a drainage trench extending alongside a roadway is provided. The system includes a mobile platform having a hopper portion rotatably coupled to a track portion, the hopper portion defining a storage compartment for intermediately storing the fragmentized stonework material received from a predetermined source. A dispensing arm portion is coupled to extend transversely from the storage compartment, the dispensing arm portion being selectively activated to convey and expel the fragmentized stonework material for one layer from the storage compartment into the drainage trench. The dispensing arm portion includes an elongate chute and an automated conveyor mechanism disposed to transport the fragmentized stonework material therethrough. An actuating portion couples the dispensing arm portion to the mobile platform in angularly displaceable manner. A controller is coupled to selectively activate the actuating portion and thereby adjust the dispensing arm portion in angular position relative to the storage compartment to maintain substantially even distribution of the fragmentized stonework material within each layer of the infiltration structure.

In certain other embodiments a method is provided for successively depositing layers of respective fragmentized stonework materials to form a multi-layered infiltration structure within a drainage trench extending alongside a roadway. The method includes establishing mobile platform defining a storage compartment for intermediately storing the fragmentized stonework material for one layer received from a predetermined source and establishing a dispensing arm portion coupled to extend transversely from the storage compartment. The dispensing arm portion is selectively activated to convey and expel the fragmentized stonework material from the storage compartment into the drainage trench. The method further includes establishing an actuating portion which couples the dispensing arm portion to the mobile platform in angularly displaceable manner. Furthermore, the method includes controlling the actuating portion to adjust the dispensing arm portion in angular position relative to the storage compartment to maintain substantially even distribution of the fragmentized stonework material within each layer of the infiltration structure.

DESCRIPTION OF THE PREFERRED EMBODIMENTS

Figure 1:
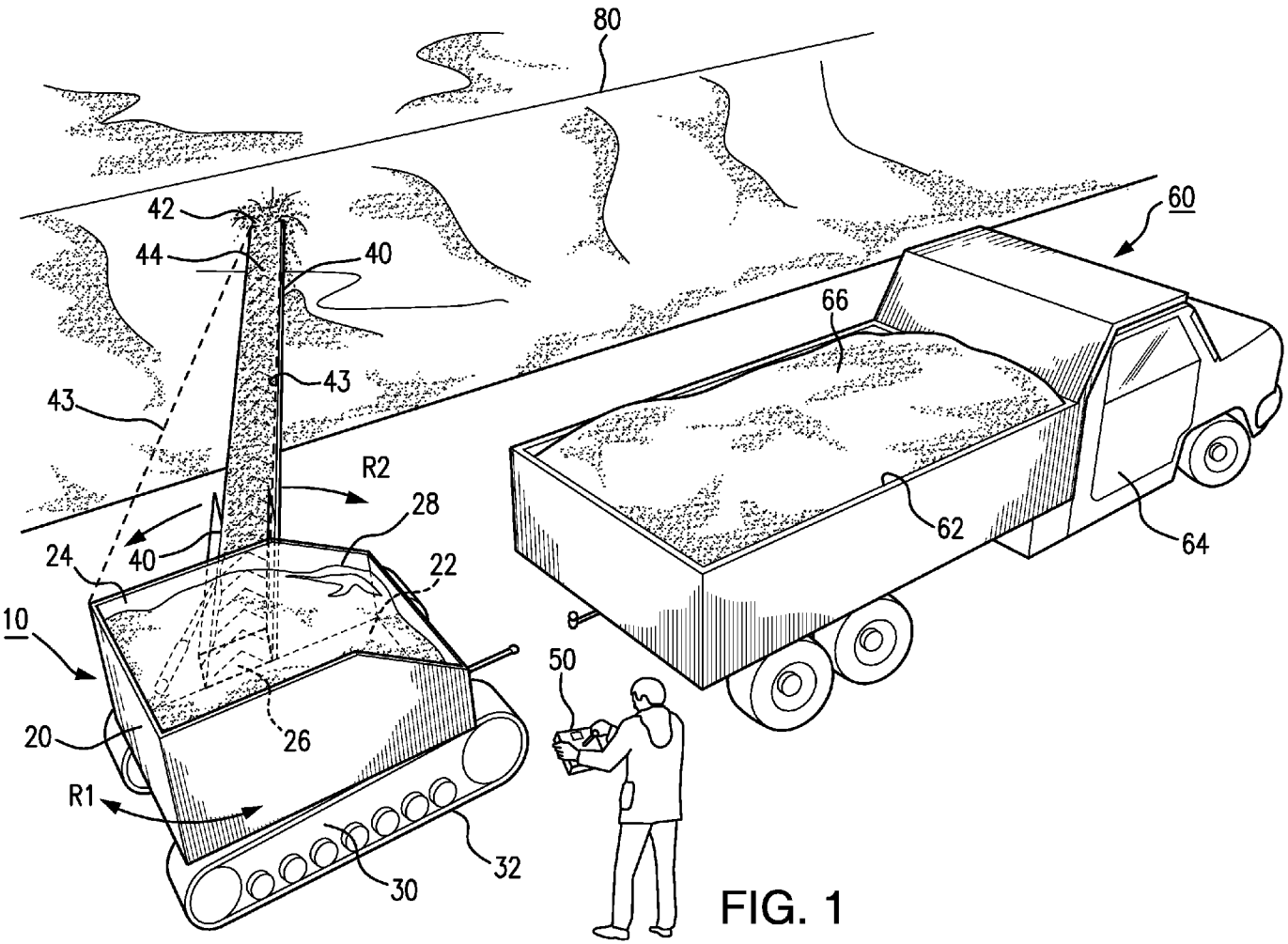
FIG. 1 is a schematic perspective view of a system formed in accordance with an exemplary embodiment of the present invention showing certain features of an infiltration trench filler vehicle (ITFV) including a storage compartment in communication with a conveyor for dispensing material into a trench.

In broad concept, a system and method implemented in accordance with various embodiments of the present invention make use of several main units including a mobile platform, implemented in the embodiment shown as an infiltration trench filler vehicle (ITFV) 10. The ITFV 10 is equipped with a storage compartment 20, a propulsion mechanism 30, a dispensing conveyor 40, and a control 50 unit operably linked to the ITFV 10.

Preferably, the ITFV 10 is formed for simplicity to be similar in certain aspects to an asphalt paving machine, and is equipped with a motor to control the propulsion mechanism to maneuver the vehicle. The storage compartment (ie: hopper) 20 of the ITFV is in communication with the ITFV chassis and defines a space for holding filler material. The storage compartment 20 may be oversized with a built-in feed mechanism or may be natural gravity fed with a vibrator mechanism disposed therein to shake quickly (or otherwise agitate) the material to keep the material filtering downward toward the floor 22 of the compartment 20, until it eventually is dispensed for expulsion into the trench. Alternatively, the storage compartment is configurable to work in conjunction with extraneous machine that acts as an agitator to keep material flowing until its eventual release for delivery into the trench.

The ITFV is disposed upon the chassis in a manner which enables it to be selectively turned in rotation direction R1 as shown in FIG. 1. Depending upon the particular application, it is preferable for the storage compartment to be rotated relative to the vehicle chassis, as well as being tiltable upward in addition to its left and right turning ability. The ITFV storage compartment 20 may vary in structural configuration depending on the material that is being used in a given application.

Figure 2:
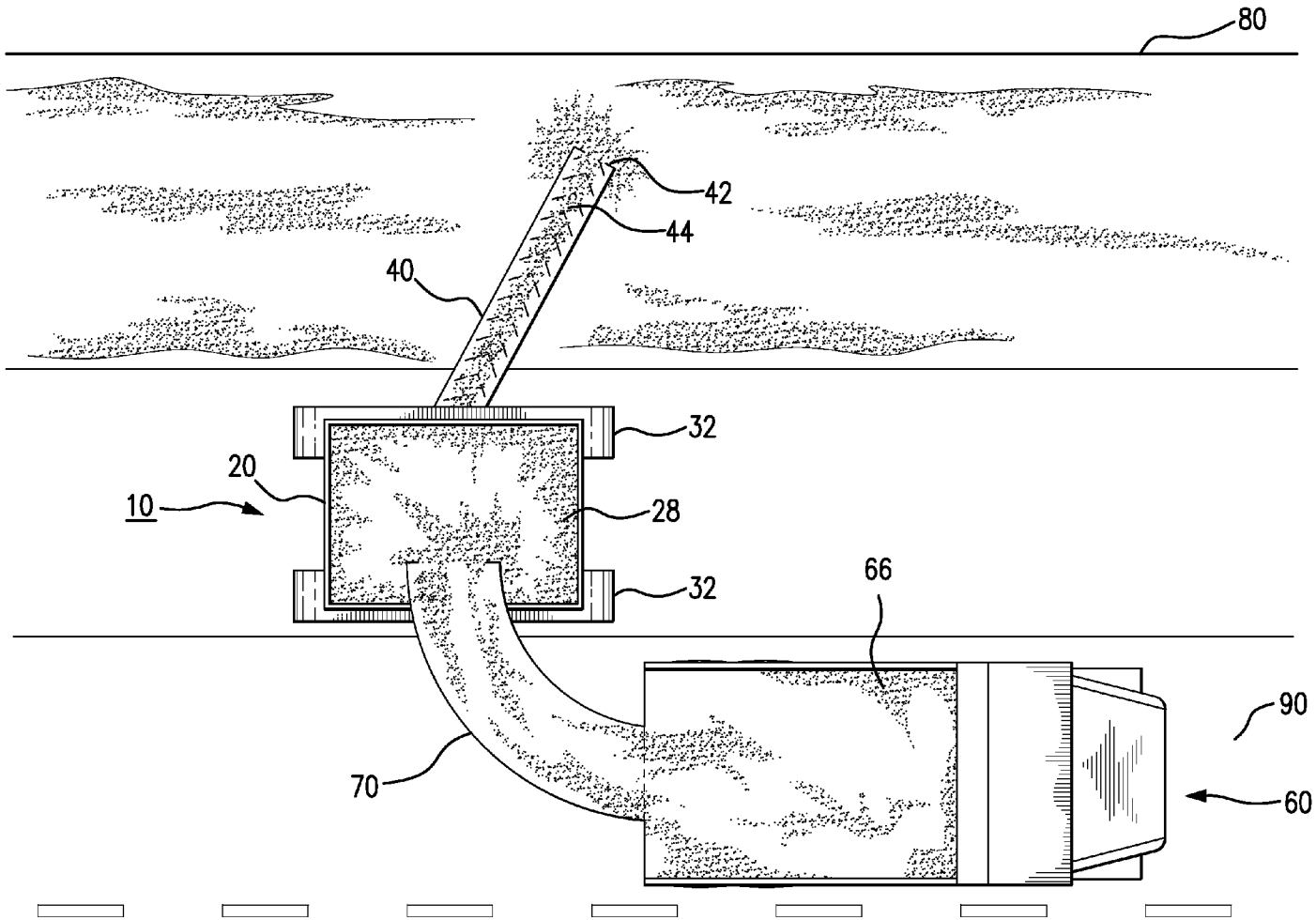
FIG. 2 is a schematic top view of the system shown in FIG. 1 illustrating the passage of material from a dump truck into the storage compartment of the ITFV via a chute, and subsequently from the storage compartment into the trench via a dispensing conveyor; and, FIG. 3 is a schematic cross-sectional view of a trench illustrating a plurality of different layers of material filled therein by the ITFV formed in accordance with exemplary embodiments of the present invention.

An opening 26 is preferably formed in a sidewall 24 of the storage compartment 20 for passage of filler material therethrough. In one illustrative embodiment, the ITFV 10 is self-propelled and therefore mobile along unpaved and relatively unstable terrain. Preferably, this ITFV 10 is equipped with a pair of endlessly looped tracks 32 as shown in FIGS. 1 and 2 (much like typical tractor or tank tracks) on which a main chassis is carried. Such a configuration enables the ITFV to travel off of paved road surfaces and to withstand various terrains and environmental conditions. The tank-like tracks 32 help to ensure that changes in the weather and consequent deterioration of ground conditions do not overly impede the progress of a trench filling operation. However, such is provided for exemplary purposes only and the propulsion mechanism 30 may assume any suitable alternative type or configuration, such as treaded wheels, capable of providing sufficient stability, traction and maneuverability. To prevent the vehicle from tearing up the road surface, it may be further desirable for the tank-like tracks 32 to be made of rubber or other similar material.

The chassis preferably includes a hopper which in turn defines the storage compartment 20 for storing the material 28 to be dispensed, typically a fragmentized stonework material. This may be sized according to the particular needs of a given embodiment. Preferably, the hopper 20 is adjustably carried on the chassis such that the hopper 20 (or the chassis itself) is angularly displaceable relative to the tracks 32 in rotation direction R1 shown in FIG. 1. Such rotatability of hopper 20 is preferably configured to turn much like the turret of a tank, so as to augment or otherwise facilitate the range of angular displacement realized for its dispensing conveyor 40, and enhance the ease and precision of control. The dispensing conveyor 40 is configured to extend through an opening 26 within a sidewall 24 of the hopper 20.

An actuating portion is mechanically driven to control the angular displacement of the dispensing conveyor 40 relative to the hopper 20. In certain embodiments, the dispensing conveyor 40 is configured to be adjustable in length to ensure its reach for even material coverage of the given trench, again to best accommodate the requirements of the given application.

The dispensing conveyor 40 is attached to the coupling mechanism through the opening 26 of the storage compartment 20 much in the manner as conveyor belts that are used to unload luggage from the side of an airplane, and those often used as stone shooters machines. However, in contrast to conventional stone shooter machines which are fixed to remain stationary while in use and are limited in load capacity (typically only capable of holding between 8 and 9 tons of stone materials), the dispensing conveyor 40 of the ITFV 10 is preferably capable of accommodating a heavier loads of stone or other filler material thereon. Additionally, the ITFV 10 is constructed to expel material into a trench while simultaneously traveling along the adjacent roadway 90. Preferably, the ITFV 10 is propelled along a roadway at a predetermined speed or range of speeds (for example, at approximately 1-2 miles per hour), but may be suitably accommodated to travel at higher speeds depending upon the particular application intended. As the ITFV 10 travels adjacent to a trench 80, material passes from the storage compartment 20 through the opening 26 onto a belt 44 of the dispensing conveyor 40 for transport and forcible release into the trench 80.

The dispensing conveyor 40 is coupled to the storage compartment 20 by an actuating portion. Thereby, the dispensing conveyor 40 is selectively, angularly displaceable with respect to the storage compartment 20. FIG. 1 illustrates material being dispensed from conveyor 40 into the given trench at a mid portion thereof. By adjusting the angular displacement of conveyor 40 during operation, a user selectively controls the point of release of fragmentized stonework material from conveyor 40 over the trench. For instance, conveyor 40 may be angularly rotated from a dispersal position corresponding to the near bank of a trench (ie: the portion closest to the adjacent roadway) to a dispersal position corresponding to the far bank of a trench (ie: the portion furthest from the adjacent roadway) while assuming an intermediate dispersal position at a mid portion of the trench, as shown in FIG. 1. This angular displacement of conveyor 40 may be controlled in combination with the rotatibility of storage compartment 20 ensure that each layer of fragmentized stonework filler material fully and uniformly covers the entire width of the trench, as the ITFV 10 is gradually advanced alongside the trench. This largely obviates the need for manual labor to spread the heavy, fragmentized stonework material dispensed into the trench, although certain applications may require minimal manual touch up to optimize substantially even distribution of each layer of material.

As can be seen in FIGS. 1 and 2, the distal, free end of the dispensing conveyor 40 is suspended to hang from the ITFV 10 like a gutter or a chute from which stone is thrown. Preferably, stabilization cables 43 are attached at opposing ends to the suspended end of the dispensing conveyor 40 and a natural support structure (for instance a tree) or a manmade support structure (for instance, any suitably strong portion of the hopper itself).

The stabilization cables 43 may be of any length suitable to provide effective stabilization and prevent the excessive bounce that may otherwise occur at the free-hanging dispensing conveyor 40 during system operation. When used in conjunction with natural support structures, after traveling a certain distance, the stabilization cables would be detached from their initial connection on a particular tree, for example, and moved to another connection point further along the roadway.

The dispensing conveyor 40 is of predetermined width as suited for the particular application intended (such as for example 18 inches), and is preferably configured as an endlessly looped belt 44. This endlessly looped belt 44 is preferably formed, for example, of a rubber belt or a metallic belt material but may comprise of any other material or combination of materials which are sufficiently durable yet flexible. The dispensing conveyor 40 is capable of withstanding a certain load of material sufficient for the particular application intended. For example, a dispensing conveyor 40 on the order of approximately twelve inches in width may be formed to withstand a load capacity of fragmentized stonework material measuring in volume about four inches in depth. The amount of load that the mechanism may withstand is dependent upon the dimensions and structural configuration of the dispensing conveyor 40 itself, and the speed at which the belt 44 is driven. Preferably, the speed may be adjustably increased or decreased, depending upon the desired load to be carried by the dispensing conveyor 40. Additionally, rotation speed of belt 44 controls the thrust of material that is dispensed from conveyor 40 into a trench. Rotation speed may be controllably increased to increase propulsion distance of material dispensed therefrom and decreased (given the same load or weight of material) when it is desirable for material to travel a shorter propulsion distance.

In certain exemplary applications, the dispensing conveyor 40 may extend 20-30 feet from the hopper opening yet may be configured to any suitable length which allows the dispensing conveyor 40 to span the distance between the ITFV 10 and the trench 80 (or at least to provide adequate coverage thereof with the dispensed material). The distance from road to trench varies from one trench to the next and there may even be some discrepancy in the distance along the same trench at different portions of the road. To correct for road curvature and the like, the dispensing conveyor 40 may be angularly adjusted with respect to the opening. The control unit 50 controls the angular position of the dispensing conveyor 40 activating the actuation portion to effect its angular position in the left and right directions, as illustrated. The control unit 50 may be housed onboard the ITFV10 for controlling the movement of the dispensing conveyor 40 or alternatively may be remotely disposed and wirelessly linked to control the movement of the dispensing conveyor 40. Furthermore, the control unit 50 maybe connected via a wired, or otherwise tethered, link.

In a variation of the preceding embodiment, the ITFV 10 may be self-propelled and equipped again with a suitably sized/adjustable hopper 20 and suitably sized/adjustable dispensing conveyor 40. In addition, this ITFV 10 is operatively coupled to a dump truck 60 or other mobile source for the material to be dispensed via a feed chute 70 (as shown in FIG. 2, for example) which directs the load 66 from the dump truck 60 to the hopper 20, from which the material is dispensed into the trench 80 via the dispensing conveyor 40 (in FIG. 2). This provides the added advantage of prolonged periods of continual filling operation. That is, the continuous feed from the dump truck 60 allows a ITFV 10 with even a modest sized storage compartment 20 to continually feed a longer stretch of the trench 80 without having to pause for re-filling. This is made possible by the fact that a dump truck 60 or other source vehicle travelling on a more stable, paved road surface 90 alongside the ITFV 10 may carry much greater loads 66 than the ITFV 10 itself. This eases the size and weight requirement for the ITFV and its hopper 20.

In other embodiments, the ITFV 10 itself may not be self-propelled. It may be towed by a dump truck 60 or other hauling vehicle. The ITFV 10 itself will again be equipped with a suitably sized hopper or storage compartment 20 which is preferably carried on a pair of tank-like tracks 32 or could be designed like a sled on rollers or a cart-like structure. Suitable controls will be available for either via remote or tether controls to adjust the hopper 20 and/or the dispensing conveyor 40 in angular direction (and length in the case of the dispensing conveyor 40). In this embodiment, the filling operation may need to be paused periodically for the hopper 20 to be filled once its contents have been fully dispensed. However, since the ITFV is being hauled, the ITFV 10 would not need its own engine or transmission, this may free up additional space that would otherwise be used by mechanical equipment enabling the storage compartment 20 to be of a larger dimension for storing a greater amount of trench filling material in a given load. The would limit the major automated components therefor to a mechanism to dispense the payload from within the storage compartment 20 into a trench 80.

In one of numerous examples, a given application may require approximately 20 tons of material to cover one layer of a 200 foot trench. The storage compartment 20 would then be configured with at least 10 ton capacity. Therefore to fill a 200 foot trench, the storage compartment 20 would need to be filled twice for each layer of filler material. Trenches are preferably filled with at least 4-5 different layers of filler material. Generally, a layer of small stones approximately, for example, 4 inches deep is first filled into the drainage trench. Thereafter, a layer of bioretention soil is added followed by another layer of stone. A layer of sand is disposed onto the second layer of stones and is topped with an additional layer of sand or peagavel as the uppermost layer. It is preferable to arrange the layers to ensure rapid filtration of runoff through the trenches and therefore, the layers may be interchanged depending upon the particular application.

To streamline the filling process in accordance with certain embodiments of the present invention, the ITFV 10 is disposed in communication with a dump truck 60 which acts as a replenishing vehicle riding in front of, behind or along side the ITFV 10. Once the primary load of storage material 28 has been expelled from storage compartment 20, material from the bed 62 of dump truck 60 is transferred to storage compartment 20 and the filling process continues the remaining length of the trench. The process begins with the first layer L1 of approximately 4 inches of stones measuring size 6. Subsequently, a layer L2 of bioretention soil is added followed by a second layer of stones L3. A layer of sand L4 is added onto the second layer of stones L3. The topmost layer L5 may be peagavel or sand. Depending upon the resources available in varying applications, the filling process may utilize a single dump truck 60 which will be refilled with the different layers of material after completing each layer in sequence, or a plurality of trucks 60 may be utilized, each filled with a different layer of material.

Figure 3:
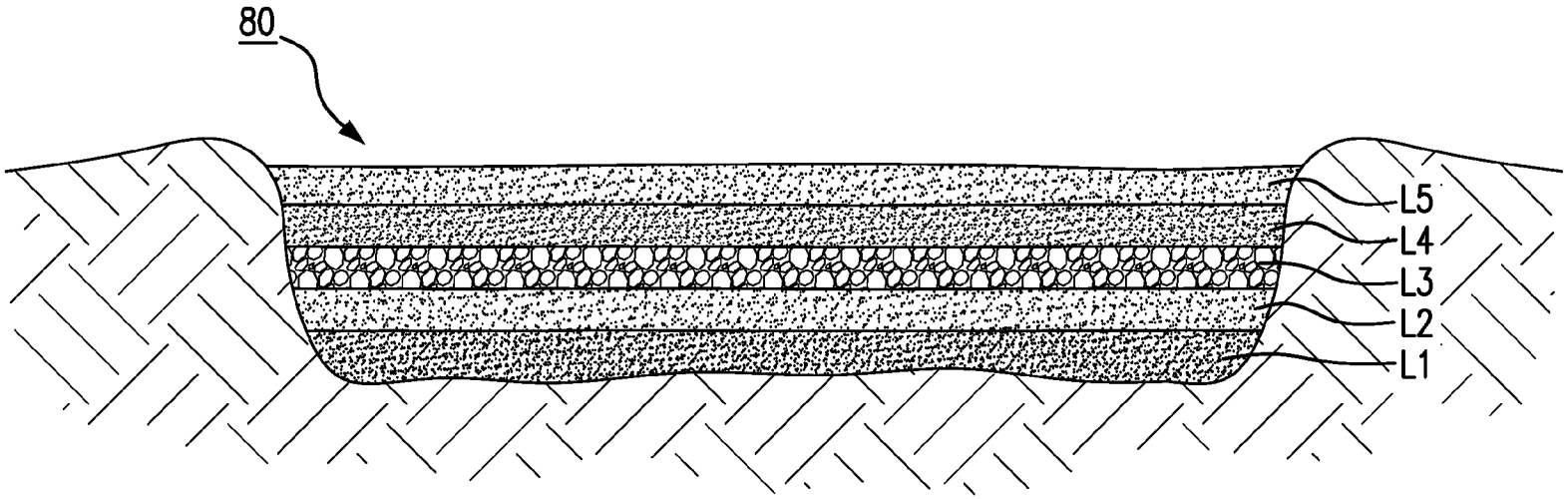

As each of the layers L1-L5 is filled into the trench 80, it is desirable to have workers or machinery of some kind in the trenches to even out the layers. This helps to ensure the neatly packed striated pattern as seen in FIG. 3. While FIG. 3 has been shown and described with reference to particular materials for each of the layers L1-L5, such is provided for illustrative purposes only and may be interchanged or substituted for similar types of materials. In some instances, it may be desirable to add an additional layer to top off the trench with additional bioretention mix which acts like a sandy-loamy dirt.

In some instances, the dump truck 60 may be put into neutral and either pushed or pulled by the ITFV 10. Alternatively, the dump truck 60 may act as a tow vehicle to pull the ITFV 10 as shown in FIG. 1. In such embodiments, the ITFV would not need to be equipped with a motor which frees up space to accommodate a large capacity storage compartment 20.

While FIG. 1 depicts a conventional dump truck 60, such trucks are known to be top heavy and therefore depending upon the particular application, it may be desirable to modify the vehicle to ride on tracks much like a tank to provide stability, traction and mobility.

In certain alternate embodiments as shown in FIG. 2, the dump truck 60 is maneuvered to travel alongside and slightly ahead of the ITFV 10. At the tail end of the truck 60, a feed chute 70 is retrofitted or temporarily attached which provides a mechanism by which to transfer filler material directly from the truck bed 62 to storage compartment 20 without interrupting the filling procedure.

The feed chute 70 is generally semi-sloped which will provide enough side protection to ensure that when it is moved and/or material is passed along the feed chute 70, the material won't spill over the side. The feed chute 70 may be equipped with a small flap that can be adjusted to control how much material is taken into the storage compartment 20. The shape of the feed chute 70 shown in FIG. 2 is provided for illustrative purposes only and the feed chute 70 may be any other suitable shape.

The feed chute 70 serves to take the load 66 from the truck 60 and, with the help of gravity, dispense it down to a predetermined point where it would be caught by the storage compartment 20 of the ITFV 10. The material is then momentarily held within storage compartment 20 until its passage through opening 26 onto belt 44 of dispensing conveyor 40 which is rotatable in the direction R2 as shown in FIG. 2. The conveyor bent 44 operates then to ultimately expel the material 28 into the trench 80. In this embodiment, the ITFV 10 need not be extremely heavy duty, and the storage compartment 20 may be of a relatively small dimension. Given the continuous communication between the dump truck bed 62 and storage compartment 20, the storage compartment 20 may be small and versatile because it need not hold 10 tons or other such excessive amounts of material. It intermediately holds just enough material to pass on without interruption into the trench 80. The storage compartment 20 is essentially serves in this regard as a relay for this dispensing process.

Depending upon the vertical height difference between truck bed 64 and storage compartment 20, a motorized mechanism may be employed to pass material from truck bed 62 into storage compartment 20. If there is a measurable height difference, material may effectively pass by gravity from the truck bed 62 to storage compartment 20. Alternatively, if the height difference is negligible, a motorized means may be necessary to move the load 66 from truck bed 62 to storage compartment 20 via feed chute 70.

Although this invention has been described in connection with specific forms and embodiments thereof, it will be appreciated that various modifications other than those discussed above may be resorted to without departing from the spirit or scope of the invention as defined herein. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined herein.

What is claimed is:

1. A system for depositing fragmentized stonework material in layers within a drainage trench extending alongside a roadway comprising:

a mobile platform defining a storage compartment for intermediately storing the fragmentized stonework material received from a predetermined source;

a dispensing arm portion coupled to extend transversely from said storage compartment, said dispensing arm portion being selectively activated to convey and expel the fragmentized stonework material from said storage compartment into the drainage trench;

an actuating portion coupling said dispensing arm portion to said mobile platform in angularly displaceable manner; and, a controller coupled to selectively activate said actuating portion and thereby adjust said dispensing arm portion in angular position relative to said storage compartment to maintain substantially even distribution of the fragmentized stonework material in the drainage trench, wherein said actuating portion includes a stabilizing arm extending between said dispensing arm portion and said mobile platform, said stabilizing arm being reconfigurable in length to actuate the angular displacement therebetween; and, wherein said mobile platform includes a hopper portion rotatably coupled to a track portion, said hopper portion defining said storage compartment, said dispensing arm portion being coupled to an opening formed in said hopper portion to be angularly displaceable thereabout.

2. The system as recited in claim 1, wherein said dispensing arm portion defines an elongate chute, said dispensing arm portion including an automated conveyor mechanism to transport the fragmentized stonework material through said chute.

3. The system as recited in claim 2, wherein said automated conveyor mechanism includes a looped conveyor belt selectively driven to adjustably propel the fragmentized stonework material from said chute.

4. The system as recited in claim 1, wherein said mobile platform is selectively displaced along the drainage trench during activation of said dispensing arm portion, said controller selectively controlling the angular displacement of said dispensing arm portion in coordination with the displacement of the mobile platform and rotation of said hopper portionfor depositing a substantially even layer of the fragmentized stonework material being along the drainage trench.

5. A method for successively depositing layers of respective fragmentized stonework materials to form a multi-layered infiltration structure within a drainage trench extending alongside a roadway, the method comprising:

establishing mobile platform defining a storage compartment for intermediately storing the fragmentized stonework material for one layer received from a predetermined source;

establishing a dispensing arm portion coupled to extend transversely from said storage compartment, said dispensing arm portion being selectively activated to convey and expel the fragmentized stonework material from said storage compartment into the drainage trench.;

establishing an actuating portion coupling said dispensing arm portion to said mobile platform in angularly displaceable manner; and, controlling said actuating portion to adjust said dispensing arm portion in angular position relative to said storage compartment to maintain substantially even distribution of the fragmentized stonework material within each layer of the infiltration structure, wherein said dispensing arm portion is activated to adjustably propel the fragmentized stonework material into the drainage trench; and, wherein said mobile platform is selectively displaced along the drainage trench during activation of said dispensing arm portion, said controller selectively controlling the angular displacement of said dispensing arm portion in coordination with the displacement of the mobile platform and a rotation of said storage compartment, a substantially even layer of the fragmentized stonework material being thereby deposited along the drainage trench.

6. The method as recited in claim 5, wherein said predetermined source includes a plurality of load vehicles, each of said load vehicles being activated to successively haul loads of the fragmentized stonework material to said mobile platform for replenishing said storage compartment, said mobile platform being detachably coupled to at least one of said load vehicles to be hauled thereby for displacement along the drainage trench during activation of said dispensing arm portion.

7. The method as recited in claim 6, further comprising releasably securing at least one stabilization cable between a terminal end section of said dispensing arm portion and a support structure.

* * * * *